US005385532A

United States Patent [19]

Shyu

[11] Patent Number: 5,385,532

[45] Date of Patent: Jan. 31, 1995

[54] AUTOMATIC MASSAGER AND WASHER

[76] Inventor: Chih-Yes Shyu, 4F, No. 144, Chu-Lin Road, Yung-Ho Shih Taipei Hsien, Taiwan, Prov. of China

[21] Appl. No.: 181,221

[22] Filed: Jan. 13, 1994

[51] Int. Cl.[6] ..... A46B 13/06

[52] U.S. Cl. ..... 601/160; 601/112; 601/114; 601/154; 15/29

[58] Field of Search ..... 601/154, 155, 160, 114, 601/112, 113, 134; 15/28, 29

[56] References Cited

U.S. PATENT DOCUMENTS

| | | | |
|---|---|---|---|
| 3,733,634 | 5/1973 | Golbe | 601/160 |
| 3,968,789 | 7/1976 | Simoncini | 601/114 |
| 3,998,390 | 12/1976 | Peterson | 601/160 |
| 4,203,431 | 5/1980 | Abura | 601/114 |
| 4,841,590 | 6/1989 | Terry | 601/114 |

FOREIGN PATENT DOCUMENTS

| | | | |
|---|---|---|---|
| 329658 | 7/1936 | Italy | 601/160 |

*Primary Examiner*—Robert A. Hafer

*Assistant Examiner*—David J. Kenealy

*Attorney, Agent, or Firm*—Morton J. Rosenberg; David I. Klein

[57] ABSTRACT

An automatic massager and washer includes a base housing having a frontal rounded portion and a rear handle portion. A water pressure turbine is mounted in an upper center cavity formed in the frontal portion. Upper recesses are spaced around a center hollow post in the upper center cavity. A hollow post is provided in each recess for mounting a massaging wheel covered with a brush. A large gear is fixed on the center hollow post which rotates with the turbine when water flows through turbine blades formed at an outer circumference of the turbine. The large gear engages and rotates small gears fixed on bottom ends of locating rods of the massaging wheels. An oozing cap covers the top of the center post for emitting bathing milk stored in a chamber formed under the upper center cavity of the base and is actuated by an air push button fixed in the rear portion of the base housing.

1 Claim, 5 Drawing Sheets

AUTOMATIC MASSAGER AND WASHER

BACKGROUND OF THE INVENTION

A shower is commonly used in bathing, but it only serves to wash the body of a user, with no other functions.

This invention concerns an automatic massager and washer, which can supply bathing milk for cleaning one's body, massage and wash it at the same time, making use of water pressure, but using no electricity to prevent electric shock.

SUMMARY OF THE INVENTION

This invention has been devised to have the following advantages:

1. It has three functions of coating bathing milk on the body of a user, massaging, brushing and washing the body, just as a conventional shower combined with a bathing milk bottle and a massager.
2. Self-rotating massaging wheels are provided to be moved by water pressure, using no electricity to prevent a user from receiving electric shock.

An automatic massager and washer in the present invention includes a water pressure turbine combined with a round front portion of a base, a plurality of round upper recesses provided in the turbine, a plurality of massaging wheels combined with round upper recesses to rotate with small gears engaging a large gear fixed on a center hollow post fixed and rotating with the turbine when the turbine is rotated by flowing water. Each massaging wheel is covered with a brush to brush and massage the body of a user, when the small gears are rotated by the large gear, which together rotates with the turbine so that the massaging wheels are not only moved around by the turbine, but also rotates by rotation of the small gears engaging the large gear. And an oozing cap is covered on top of the center hollow post of the turbine, letting bathing milk stored in a chamber formed in the front portion of the base to be pushed out of oozing holes in the cap by compressing an air push button fixed in a rear handle portion of the base.

BRIEF DESCRIPTION OF DRAWINGS

The invention will be better understood by reference to the accompanying drawings, wherein.

DESCRIPTION OF THE PREFERRED EMBODIMENTS

Figure 1:
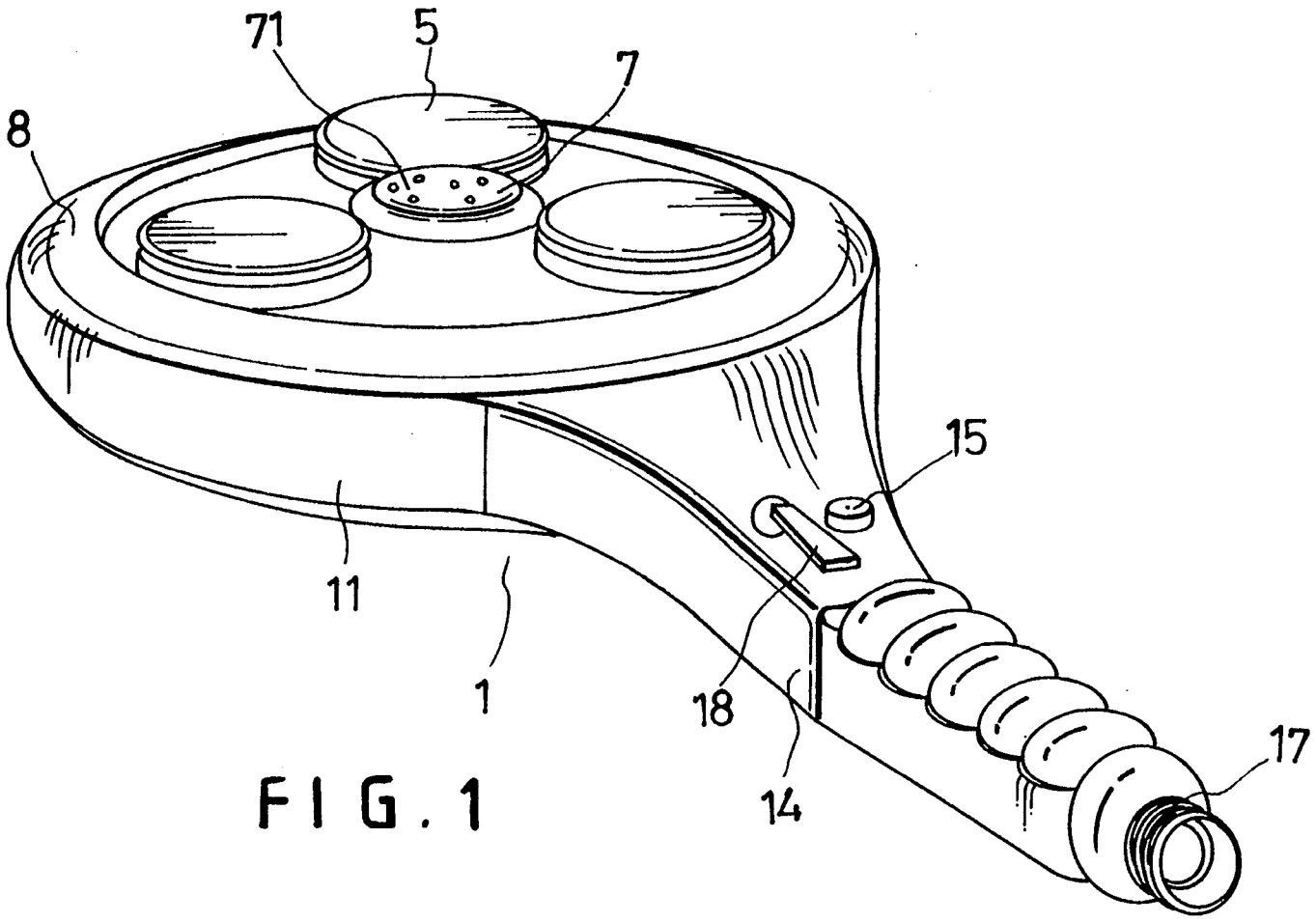
FIG. 1 is a perspective view of an automatic massager and washer in the present invention.
Figure 2:
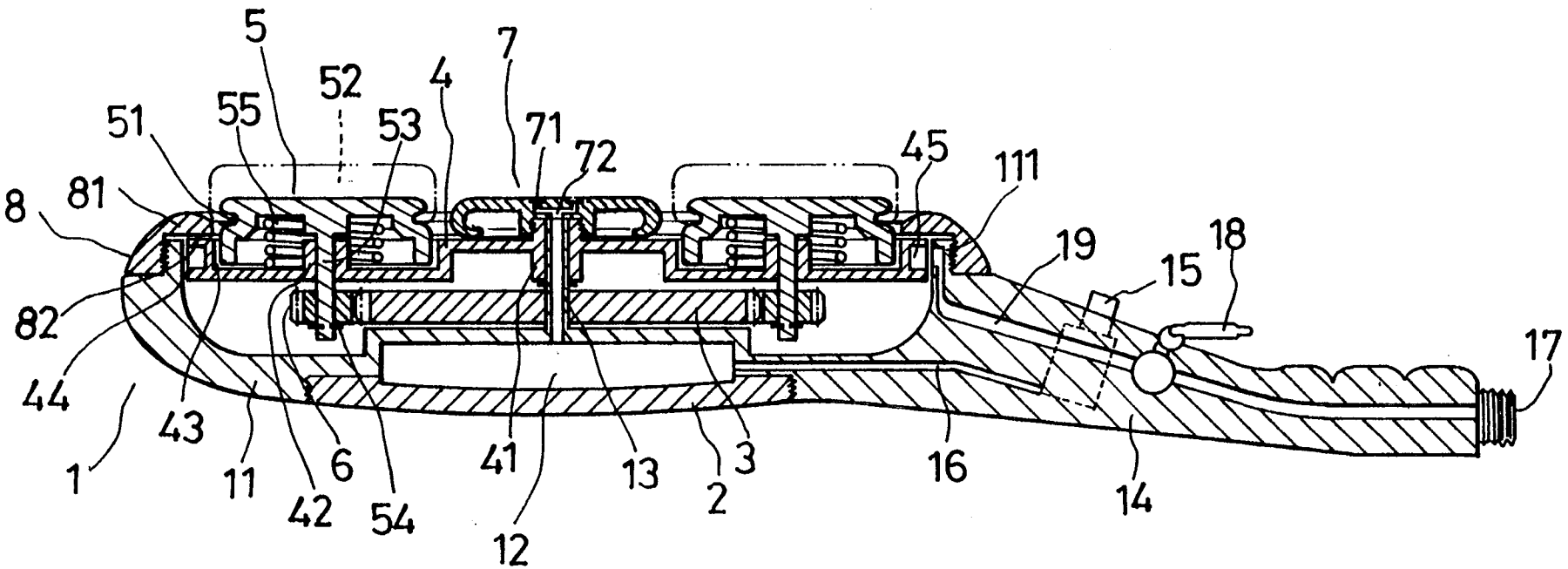
FIG. 2 is a cross-sectional view of the automatic massager and washer in the present invention.
Figure 3:
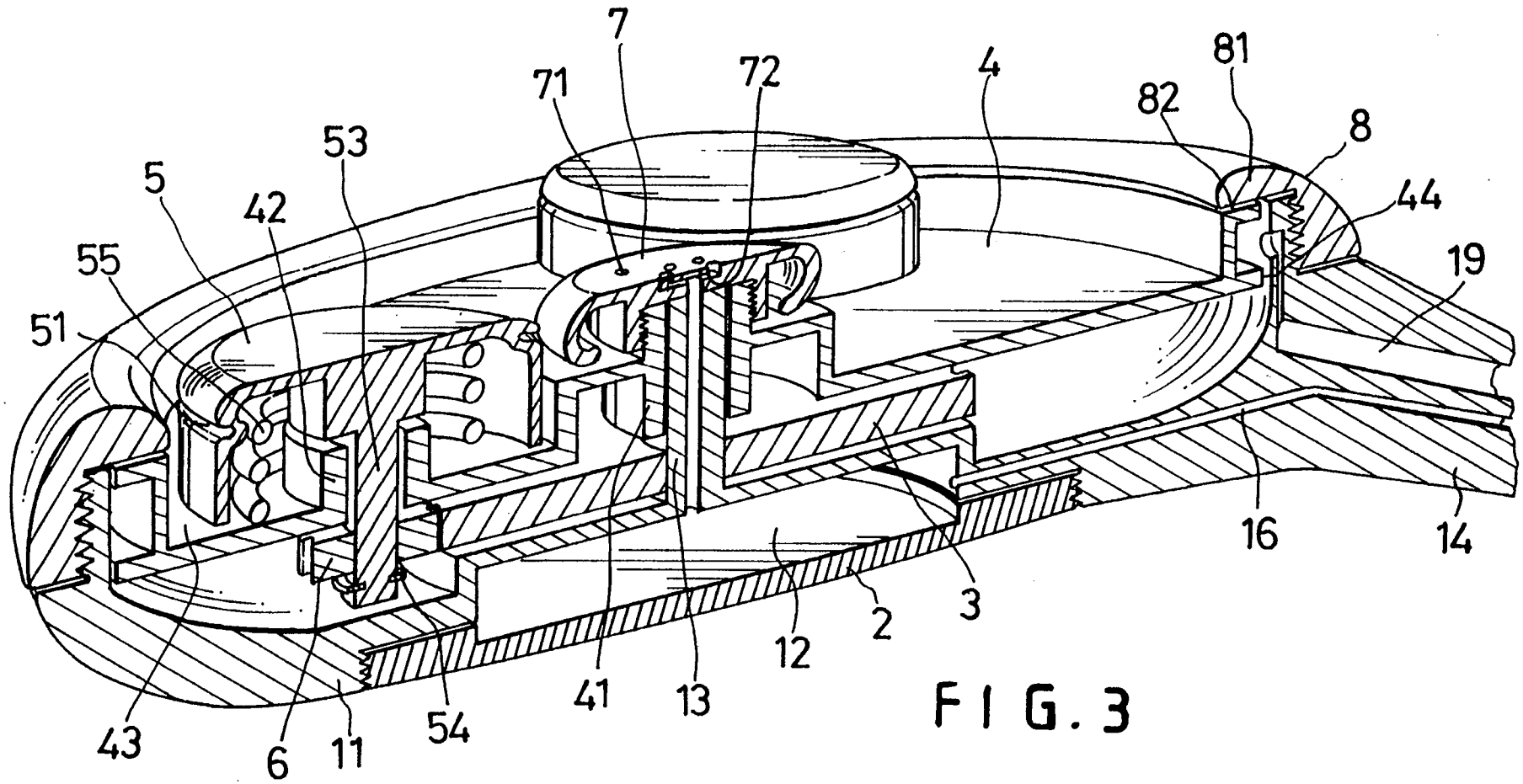
FIG. 3 is a partial cross-sectional view of the automatic massager and washer in the present invention.

An automatic massager and washer in the present invention, as shown in FIGS. 1–3, includes a base 1, a seal cap 2, a large gear 3, a water pressure turbine 4, a plurality of massaging wheels 5, a plurality of small gears 6, an oozing cap 7 and a locating ring 8 assembled together.

The base 1 has a front round portion 11 and a rear handle portion 14, a bathing milk chamber 12 provided in the front portion 11, the seal cap 2 threadably sealing a bottom opening of the chamber 12, a center hollow post 13 extending upward from an upper horizontal wall of the chamber 12, a large gear 3 fixed with the center hollow post 13 and on the chamber 12. In the rear handle portion of the base 1 are provided an air push button 15 almost buried slopingly inside, an air pressure tube 16 between the push button 15 and the chamber 12, an inlet 17 in an end for connecting with a water supply tube, a water passageway 19 between the inlet 17 and an annular wall of the front portion 11 and a faucet 18 fixed with an intermediate portion of the water passageway 19.

Figure 4:
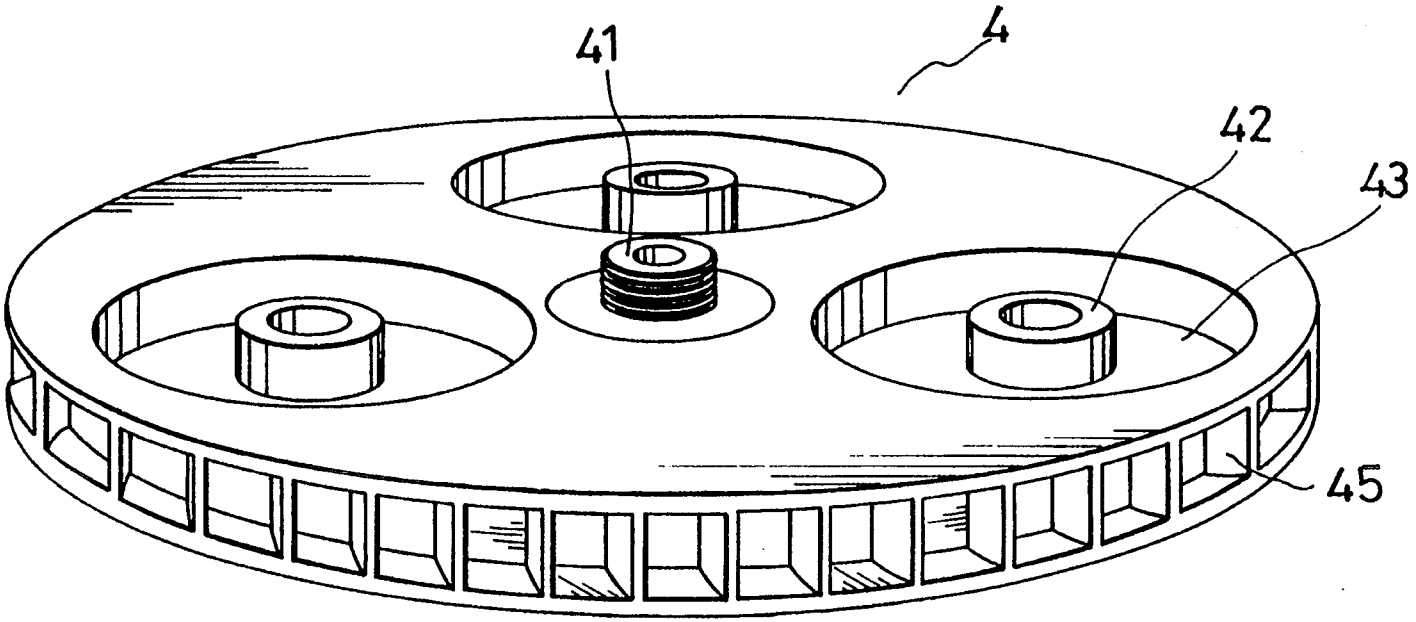
FIG. 4 is a perspective view of a water pressure turbine in the automatic massager and washer in the present invention; and, FIG. 5 is an upside view of the automatic massager and washer in the present invention, showing massaging wheels and an oozing cap in motion.

The water pressure turbine 4 as shown in FIG. 4 has a center tubular post 41 extending upward and fitting around the center hollow post 13 of the base 1, a plurality of tubular posts 42 respectively provided to extend upward in a plurality of recesses 43 spaced around the central tubular post 41, a plurality of turbine leaves 45 spaced around in an outer circumferential wall, which faces an inner circumferential wall of the front portion of the base 1 with an annular gap 44 formed between both the circumferential walls of the turbine 4 and the base 1.

The massaging wheels 5 have their circumferential edge fitting around an inner circumferential wall of each recess 43 of the turbine 4 with a little gap, an annular groove 51 around an upper portion of the circumference so that a round brush 52 may engage the annular groove 51 to be secured with each wheel 5. Each wheel 5 also has a locating rod 53 extending down to fit in the hollow of each tubular post 42 of the turbine 4, a small gear 6 fixed on the locating post 53 by means of a C-shaped ring 54, and a spring 55 fixed between an inner bottom surface of each wheel 5 and a bottom surface of each recess 43 of the turbine 4.

The oozing cap 7 is shaped round to cover on a top end of the center tubular post 41, having a plurality of oozing holes 71 for bathing milk to flow out, and a tributary passage 72 communicating with the oozing holes and the hollow of the center hollow post 13.

The locating ring 8 threadably combines with an outer upper circumference of the front portion 11 of the base 1, and a gap 82 provided between the inner circumference and the circumferential surface of the turbine 4.

Figure 5:
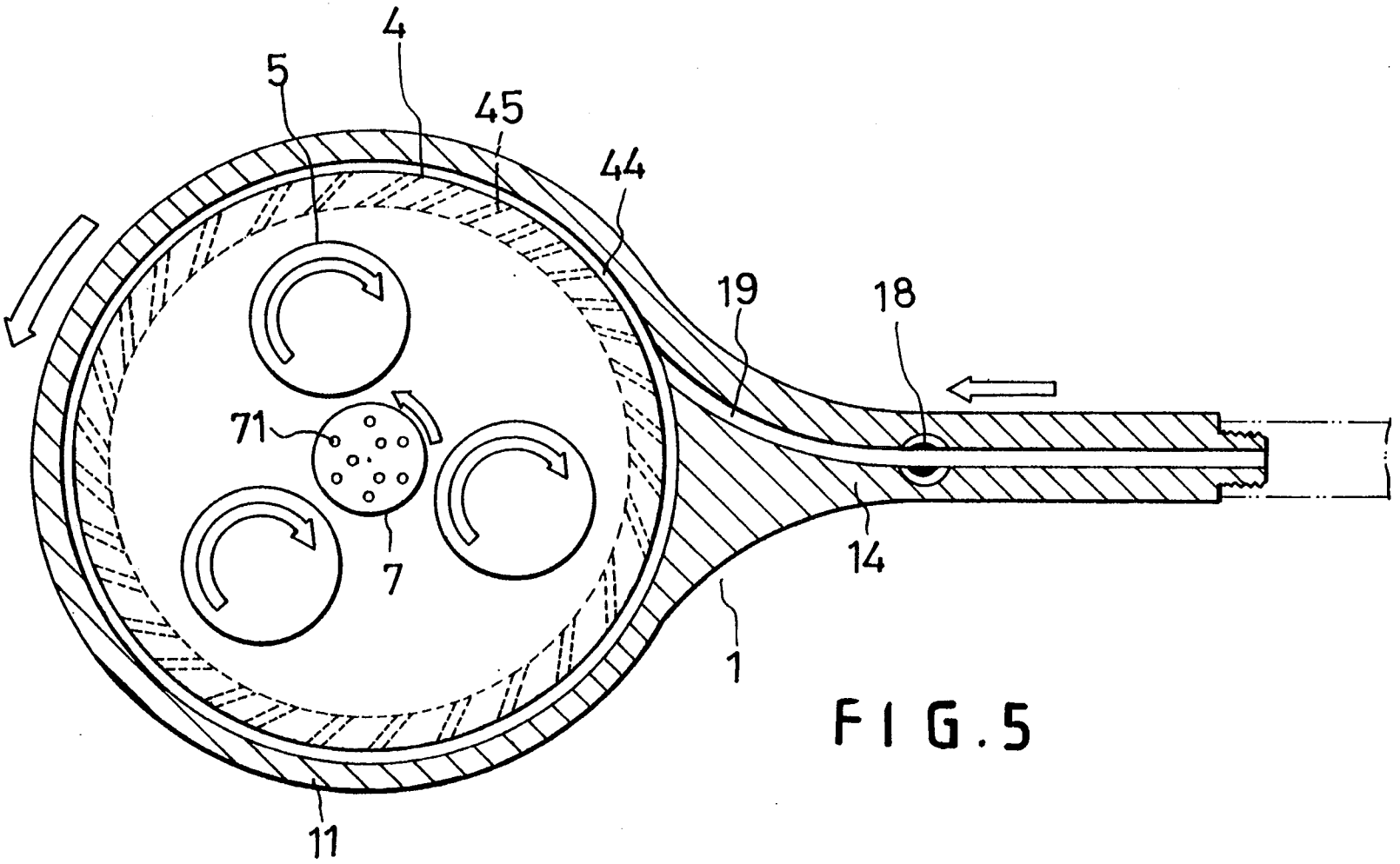

In using this massager and washer, a user holds the rear handle portion 14 of the base 1, and presses the air push button 15, forcing the bathing milk in the chamber 12 flow out of the hollow post 13 and then through the tributary passageway 72 to ooze out of the oozing holes 71. And the massager and washer is moved over around the body of the user, coating the bathing milk on the body at the same time. Next, as shown in FIG. 5, after scrubbine the body with bathing milk, the faucet 18 is to be turned on, letting water flow in through the inlet 17, the water passageway 19, and then run fast out of the annular edge 111 of the front portion 11 of the base 1. Then shooting-out water strikes on the turbine leaves 45, rotating the turbine 4, so the massaging wheels 5 move around with the turbine 4 together. At the same time, the small gears 6 engaging the large gear 3 are also rotated, and the massaging wheels 5 are rotated as well. The brushes 52 on the massaging wheels 5 then brush and massage the body of the user, by means of the spring 55 properly pushing the brushes 52 to contact the body in proper tension, performing washing, and massaging function. The water shooting out of the turbine leaves 45 runs out of gap 82 between the locating ring 8 and the gap 44 between the turbine 4 and the base 1, washing away soap bubbles on the body.

While the preferred embodiments of the invention have been described above, it will be recognized and understood that various modifications may be made therein and the appended claims are intended to cover all such modifications which may fall within the spirit and scope of the invention.

What is claimed is:

1. An automatic massager and washer comprising:

(a) a base housing having a frontal rounded portion and a rear handle portion, said rear handle portion having an inlet end adapted to be coupled in fluid communication with a water supply tube, said rear handle portion having a water conduit formed therein and extending between said inlet end and said frontal rounded portion of said base housing, said base housing frontal rounded portion having a center recessed cavity formed therein, said base housing frontal portion having a bathing milk chamber formed within a lower section thereof defined by an upper horizontal wall and a sealing cap threadedly engaged to said base housing frontal rounded portion defining a lower wall of said bathing milk chamber, said rear handle portion having an air conduit extending between and in fluid communication with said bathing milk chamber and a compressed air push button mounted on said base housing rear handle portion, said rear handle portion having mounted thereon a water faucet valve coupled to said water supply tube for controlling water flow therethrough;

(b) a center hollow post secured to said upper horizontal wall of said bathing milk chamber, said center hollow post having a vertically directed post through opening formed therethrough and in fluid communication with said bathing milk chamber;

(c) a water pressure turbine rotatably mounted within said center recessed cavity, said water pressure turbine having a center tubular post mounted around said center hollow post and rotatably displaceable with respect thereto, said water pressure turbine having a plurality of turbine blades formed on a circumferential section thereof, said water pressure turbine having a plurality of upper turbine recesses spaced about said center tubular post, each of said upper turbine recesses having a vertically directed tubular post formed therein;

(d) a large gear secured to and surrounding said center tubular post of said water pressure turbine and mounted adjacent an upper surface of said upper horizontal wall of said bathing milk chamber:

(e) a plurality of massaging wheels respectively located within each of said upper turbine recesses, each of said massaging wheels having a vertically directed center locating rod extending through a respective vertically directed tubular post and secured to a small gear at an end section of said vertically directed center locating rods, each of said small gears in meshing engagement with said large gear, said large gear being rotatably displaced by rotation of said water pressure turbine thereby rotating each of said small gears which responsively rotate each of said massaging wheels, each of said massaging wheels having a groove formed within an upper section thereof for securement thereto of a brush for massaging the body of a user; and, (f) an oozing cap having a plurality of openings formed therethrough mounted over a top end of said center hollow post in fluid communication with said vertically directed post through opening, said oozing cap being threadedly coupled to said turbine center tubular post, said bathing milk chamber containing bathing milk displaced through said oozing cap openings responsive to actuation of said compressed air push button.

* * * * *